US009612010B1

(12) United States Patent
Kimmel et al.

(10) Patent No.: US 9,612,010 B1
(45) Date of Patent: Apr. 4, 2017

(54) ENHANCED TORCH TOP BURNER

(71) Applicant: LAMPLIGHT FARMS INCORPORATED, Menomonee Falls, WI (US)

(72) Inventors: Adam S. Kimmel, Union Grove, WI (US); Ron White, North Prairie, WI (US); Richard Catalano, Hartland, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 394 days.

(21) Appl. No.: 14/100,502

(22) Filed: Dec. 9, 2013

(51) Int. Cl.

| | |
|---|---|
| ***F23D 3/18*** | (2006.01) |
| ***F23D 3/20*** | (2006.01) |
| ***F21V 37/00*** | (2006.01) |
| ***F23D 3/24*** | (2006.01) |

(52) U.S. Cl.
CPC ..... *F23D 3/20* (2013.01); *F21V 37/002* (2013.01); *F23D 3/24* (2013.01)

(58) Field of Classification Search
CPC ..... F23D 3/24; F23D 3/26; F23D 3/28; F23D 3/30; F23D 3/32; F23D 3/34; F23D 3/36; F23D 3/38; F23D 3/40; A47B 2220/01; A47B 57/00; A01G 13/10; A01G 31/02; A01G 9/02; A01G 9/12; A01G 5/04; A01G 7/00; A01G 9/00; A01G 9/022; A01G 13/0231; A01G 13/0268; A01G 1/005; A01G 1/007; A01G 25/02
See application file for complete search history.

(56) References Cited

U.S. PATENT DOCUMENTS

| | | | | |
|---|---|---|---|---|
| 243,134 | A | 6/1881 | Hinrichs et al. | |
| 1,705,877 | A | 3/1929 | Ramsey | |
| 2,122,624 | A | 7/1938 | Sauer | |
| 2,313,784 | A | 3/1943 | Then | |
| 2,684,182 | A | 7/1954 | Gey | |
| 2,836,043 | A | 5/1958 | Spethmann | |
| 3,364,704 | A | 1/1968 | Bernstein | |
| D219,062 | S | 10/1970 | Kozoil | |
| D225,674 | S | 12/1972 | Reese | |
| 3,727,810 | A | 4/1973 | Douty | |
| 4,075,785 | A * | 2/1978 | Jones | A01G 31/06 47/62 A |
| 4,174,702 | A * | 11/1979 | Rappaport | A61F 7/032 126/208 |
| D262,999 | S | 2/1982 | Spencer | |
| 4,477,247 | A | 10/1984 | Kumasaka | |

(Continued)

FOREIGN PATENT DOCUMENTS

| | | |
|---|---|---|
| CN | 101545583 | 9/2011 |
| WO | WO2004108219 | 12/2004 |

OTHER PUBLICATIONS

Pipe-Line Denmark, "Elipse Advanced Burning Control".
Pipe-Line Denmark, "The Torch Master Brochure", Publisher: http://www.pipe-line.dk/pdf/English2007WEB.pdf.

*Primary Examiner* — Kenneth Rinehart
*Assistant Examiner* — Jason Lau
(74) *Attorney, Agent, or Firm* — David G. Woodral; Gable Gotwals

(57) ABSTRACT

A torch burner cap includes a wick holder, an indention defined in the cap and surrounding the wick holder, and a mesh insert at least partially situated within the indention in the cap and surrounding the wick holder.

5 Claims, 19 Drawing Sheets

(56) References Cited

U.S. PATENT DOCUMENTS

| | | | | |
|---|---|---|---|---|
| 5,083,916 | A | 1/1992 | Glennon et al. | |
| 5,405,262 | A * | 4/1995 | Appel | F23D 3/08 126/43 |
| 5,584,283 | A | 12/1996 | Messina | |
| D404,507 | S | 1/1999 | Palmer et al. | |
| 6,010,332 | A | 1/2000 | Lee et al. | |
| 6,345,978 | B1 | 2/2002 | Lu | |
| 6,435,694 | B1 | 8/2002 | Bell et al. | |
| 6,482,365 | B1 | 11/2002 | Soller | |
| 6,579,090 | B1 * | 6/2003 | Taubitz | F23D 3/08 431/126 |
| 6,663,258 | B1 | 12/2003 | Kanter | |
| 6,780,382 | B2 | 8/2004 | Furner et al. | |
| 6,802,707 | B2 | 10/2004 | Furner et al. | |
| 6,857,869 | B1 | 2/2005 | Sun | |
| 7,156,653 | B1 * | 1/2007 | DeMars | F23D 3/32 431/321 |
| 7,232,550 | B1 | 6/2007 | Rodgers et al. | |
| 7,247,017 | B2 | 7/2007 | Furner | |
| D679,048 | S | 3/2013 | White | |
| 8,435,029 | B2 | 5/2013 | Masterson et al. | |
| 8,439,669 | B2 | 5/2013 | Masterson et al. | |
| 8,550,813 | B2 | 10/2013 | Masterson et al. | |
| 2002/0164554 | A1 * | 11/2002 | Kisch | F23D 3/02 431/298 |
| 2004/0229180 | A1 | 11/2004 | Furner | |
| 2006/0057530 | A1 | 3/2006 | Kuricek et al. | |
| 2006/0144599 | A1 | 7/2006 | Leinemann | |
| 2006/0199129 | A1 | 9/2006 | Konkle, Jr. | |
| 2006/0251997 | A1 | 11/2006 | Schulte et al. | |
| 2007/0015097 | A1 | 1/2007 | Baker | |
| 2009/0294553 | A1 | 12/2009 | Wang et al. | |
| 2010/0112503 | A1 * | 5/2010 | Masterson | F21V 37/0062 431/301 |
| 2012/0276489 | A1 * | 11/2012 | Fang | F23D 3/24 431/320 |
| 2013/0027918 | A1 | 1/2013 | White | |
| 2013/0323659 | A1 | 12/2013 | White | |

* cited by examiner

ENHANCED TORCH TOP BURNER

FIELD OF THE INVENTION

This disclosure is related to liquid fueled torches in general and, more specifically, to a liquid fueled torch with flame enhancing features.

BACKGROUND OF THE INVENTION

Patio torches, also known as lawn torches or garden torches, may be used to provide lighting or decoration. Sometimes, scented oils or insect repellant oils are burned in the patio torches for additional effect. A torch may include a refillable canister that accepts liquid fuel. A torch may be mounted on or otherwise integrated with a decorative pole for display purposes.

The actual utility of a torch, in terms of light or aroma given off and the ability to repel pests, may be less than desirable. The wick is often too small, relatively speaking, to provide an effective amount of combustion. Even with larger diameter wicks or wicks that are extendable to create a larger surface area, air and flame control may become problematic, resulting in a flame that may still be too small to create the desired effect.

What is needed is a device for addressing the above and related problems.

SUMMARY OF THE INVENTION

The invention of the present disclosure, in one aspect thereof, comprises a torch burner cap. The cap includes a wick holder, an indention defined in the cap and surrounding the wick holder, and a mesh insert at least partially situated within the indention in the cap and surrounding the wick holder.

In some embodiments, the mesh insert comprises a plurality of vertical barriers. The vertical barriers may be intersected at right angles within the indention. In other embodiments, the mesh comprises a woven wire mesh.

In some embodiments, the torch burner cap includes a neck attached to an upper perimeter of the indention, the neck having a contour shaped to fit a fuel reservoir. The torch burner cap may also include a skirt attached to the neck below the indention.

The invention of the present disclosure, in another aspect thereof, comprises a torch burner cap including a fitting that is selectively attachable and detachable with a neck of a fuel reservoir, an indention atop the fitting and defining a wick holder, and a mesh insert at least partially situated within the indention.

In various embodiments, the mesh insert comprises a wire screen, or a plurality of intersected vertical barriers. At least some of the plurality of intersected vertical barriers may be intersected at right angles. The fitting may be threaded for selective attachment and detachment with a fuel reservoir having a threaded neck. The wick holder may provide a friction fit for a fiberglass wick and suspend the wick in the fuel reservoir. The burner cap may also have a skirt surrounding the fitting and sized to cover the fuel reservoir.

The invention of the present disclosure, in another aspect thereof, comprises a liquid fueled torch having a fuel reservoir and a burner cap selectively attachable and detachable with the fuel reservoir. The burner cap includes an indention proximate a top thereof, the indention providing a wick holder near a center bottom thereof. The burner cap also has a mesh insert at least partially within the indention and surrounding the wick holder.

In some embodiments, the mesh insert comprises a wire mesh. In other embodiments, the mesh insert may comprise a woven material of a plurality of vertical barriers. At least some of the plurality of vertical barriers may be intersected at right angles. The burner cap may also include a threaded connection with the fuel reservoir and a protective skirt covering the fuel reservoir.

The invention of the present disclosure, in another aspect thereof, comprises a torch burner cap with a neck having a wick holder. A downward facing skirt and a flame bowl affix to the neck. The flame bowl has a larger diameter at an upper edge than a diameter of the neck. The neck is configured to affix to a liquid fuel reservoir with the skirt surrounding a portion of the reservoir.

Some embodiments of the burner cap provide a flame enhancing insert in the flame bowl. The flame bowl may have a diameter at the upper edge that is at least twice the diameter of the neck.

DETAILED DESCRIPTION OF THE PREFERRED EMBODIMENTS

Figure 1A:
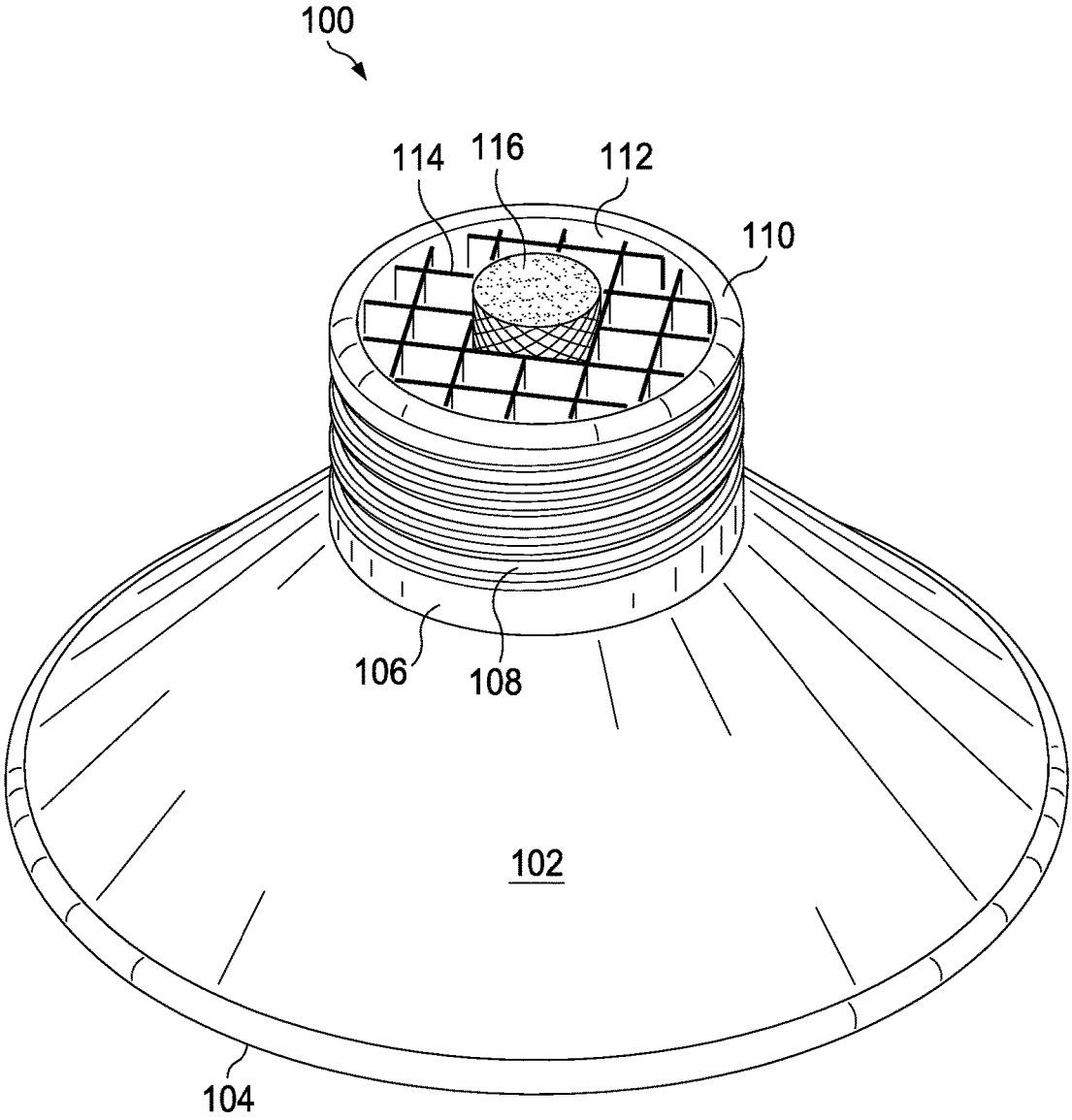
FIG. 1A is a perspective view of a torch burner cap according to aspects of the present disclosure.

Referring now to FIG. 1A, a perspective view of a torch burner cap 100 according to aspects of the present disclosure is shown. The torch burner cap 100 as shown in FIG. 1A is attachable to a liquid fuel reservoir to form a complete liquid fueled torch, as will be explained in greater detail below. In the present embodiment, the cap 100 has a skirt 102 facing downward with a lower rolled edge 104 that circumscribes a lower portion of a neck 106. The neck 106 is fitted with threads 108 or other attachment means for attaching to the fuel reservoir. In the present embodiment, an upper portion of the neck 106 has a rounded edge 110 rolling into an indention 112. In the present embodiment, the indention 112 is at least partially filled by a mesh insert 114. The indention 112 also defines a wick holder that retains a wick 116 in a friction fit relationship.

In the present embodiment, the mesh insert 114 provides a plurality of vertical barriers that fit at least partially within the indention 112. The barriers may be affixed relative to one another at regular repeating intervals and angles. In the present embodiment, the mesh insert 114 defines a network of vertical barriers that intersect at right angles and therefore form a number of square openings into the indention 112. In operation, the mesh insert 114 provides for promotion of sooting or carbon buildup around the wick 116. This sooting or carbon buildup may also enhance fuel seepage from the wick 116, which promotes a larger and more robust flame than would otherwise be available from the wick 116.

Figure 1B:
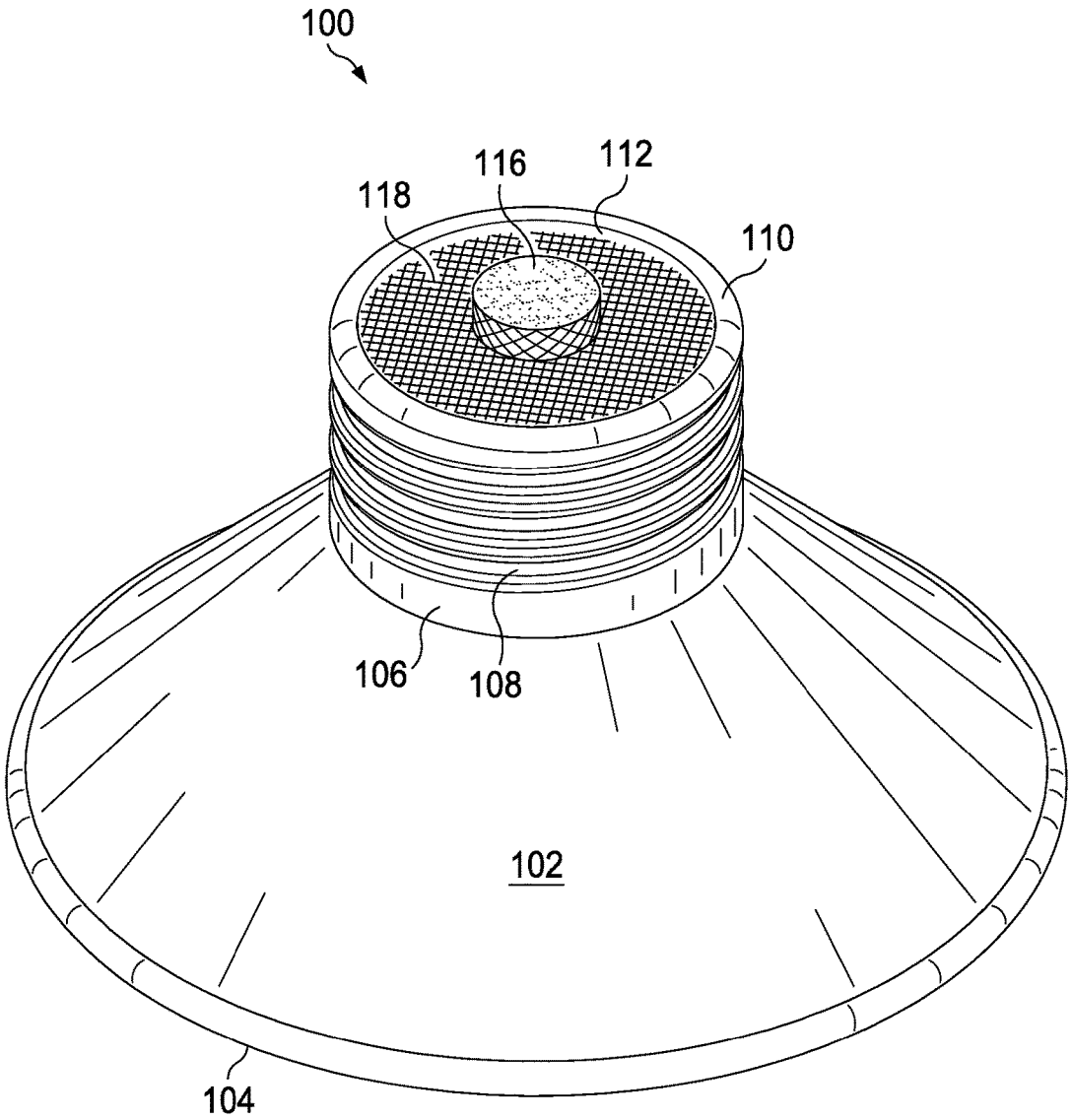
FIG. 1B is a perspective view of another torch burner cap according to aspects of the present disclosure.

With reference to FIG. 1B, it can be appreciated that a mesh insert may take on various additional forms and embodiments. In FIG. 1B, the mesh insert 114 is replaced with a mesh insert 118. The mesh insert 118 may be a two or three dimensional structure comprising a series of intersected wires. In some embodiments, the wires of the insert 118 may be woven together similar to that of a screen door. In other embodiments, the wires may simply be bonded together and will not necessarily be woven. As with the embodiment of FIG. 1A, the mesh insert 118 provides for fuel seepage and/or sooting and carbon buildup to promote for a larger flame effect than would otherwise be available from the wick 116.

Figure 1C:
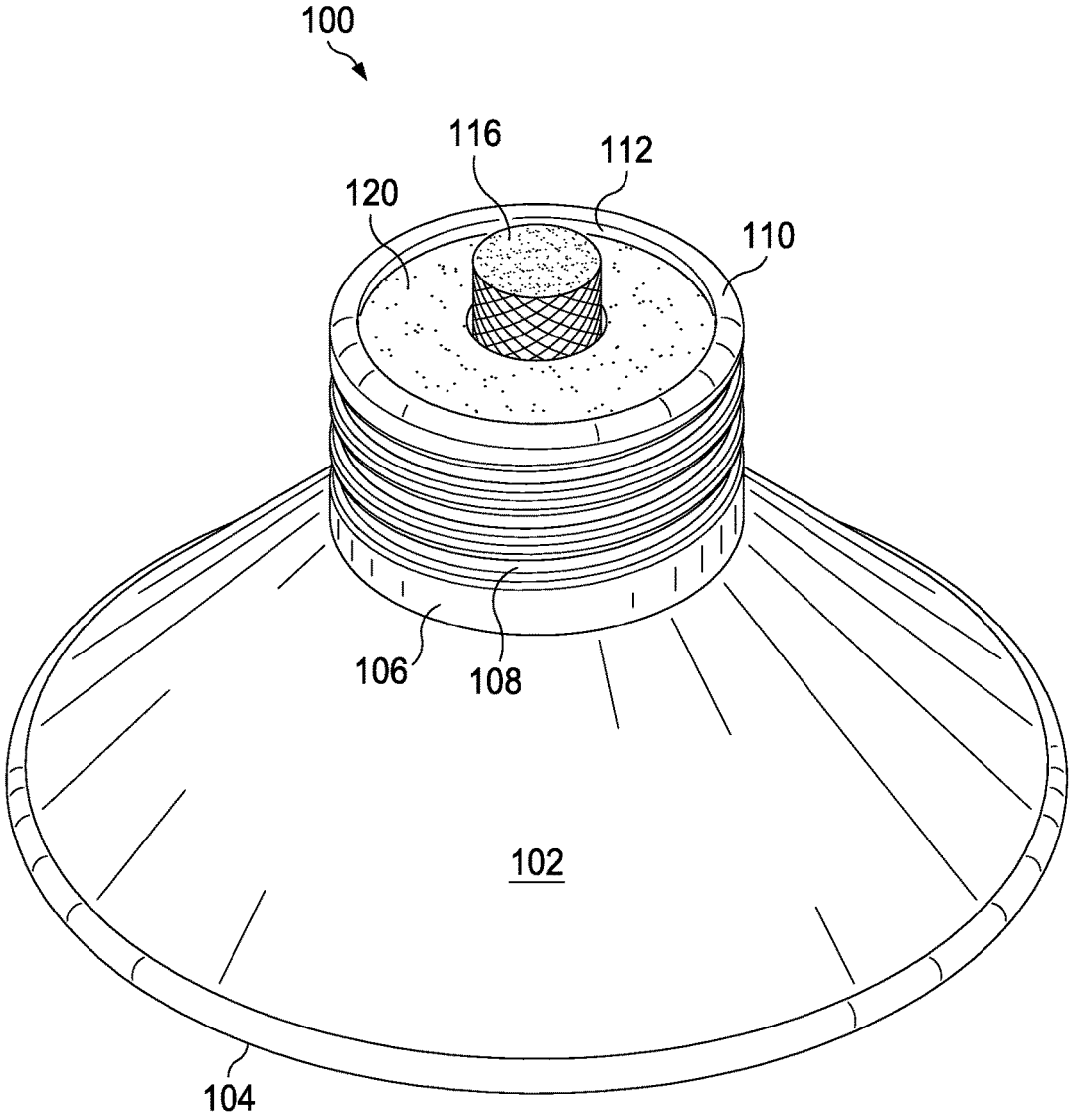
FIG. 1C is a perspective view of another torch burner cap according to aspects of the present disclosure.

With reference now to FIG. 1C, yet another type of insert 120 is shown in the cap 100. The insert 120 is once again mesh-like in that it comprises a coarse stone, rock or other heat resistant material. In one embodiment, the insert 120 is a pumice stone or other heat resistant stone. As with previous embodiments, the insert 120 promotes for fuel seepage and/or carbon buildup to provide for an enhanced flame.

Figure 1D:
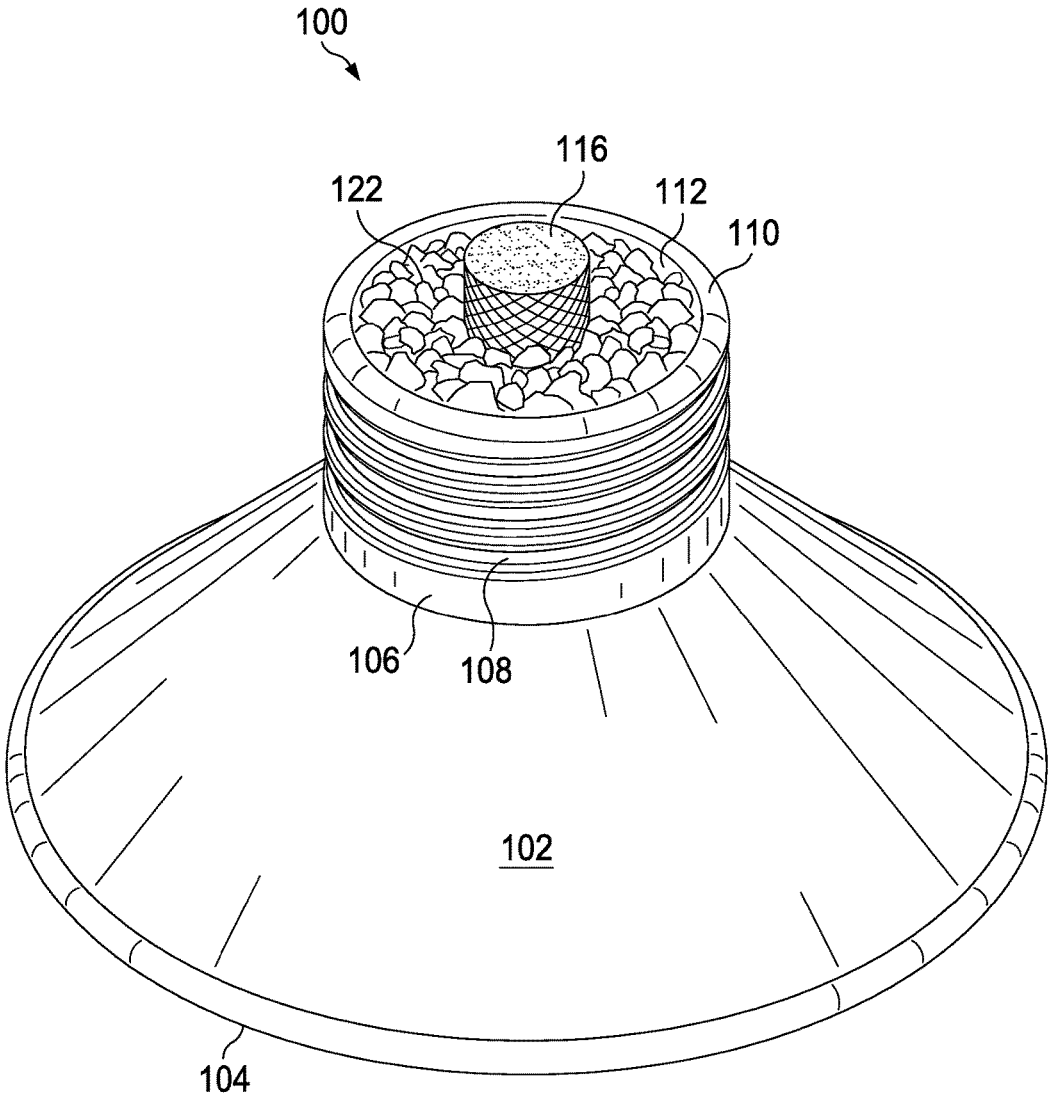
FIG. 1D is a perspective view of another torch burner cap according to aspects of the present disclosure.

Referring now to FIG. 1D, a fourth type of insert 122 is shown in the indention 112 of the cap 100. In this embodiment, the insert 122 comprises a quantity of gravel of medium coarseness. The gravel 122 will be retained by the indention 112 in order to promote fuel seepage and/or carbon buildup to enhance or enlarge the flames from the wick 116 when the wick 116 is ignited.

Figure 2:
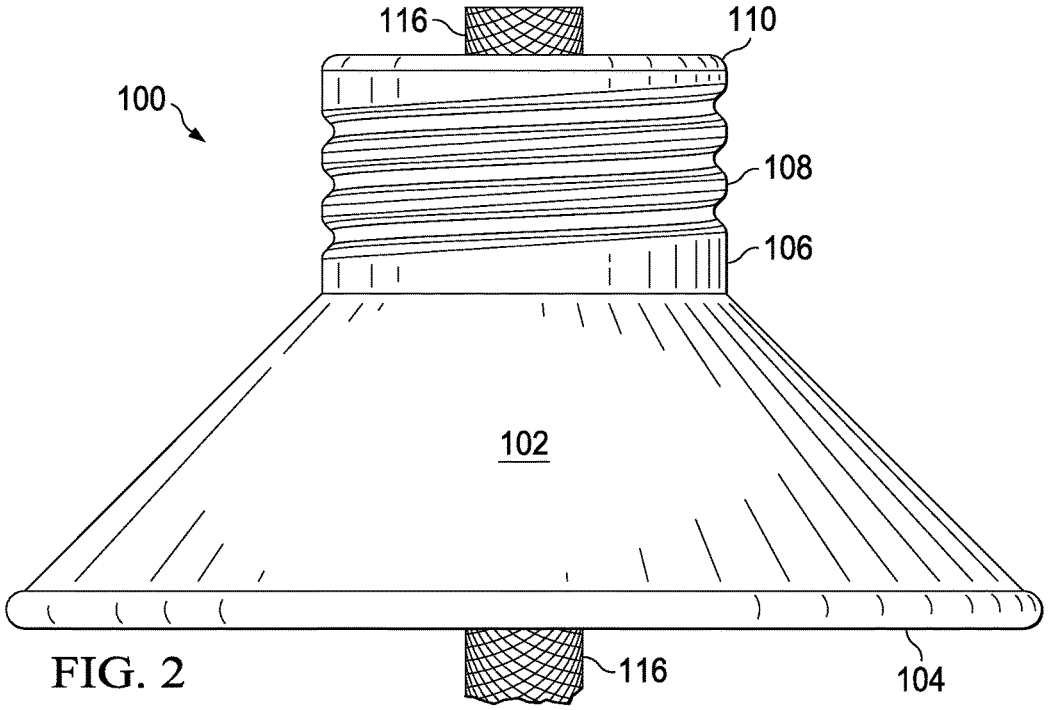
FIG. 2 is a side view of a first side of a torch burner cap according to aspects of the present disclosure.
Figure 3:
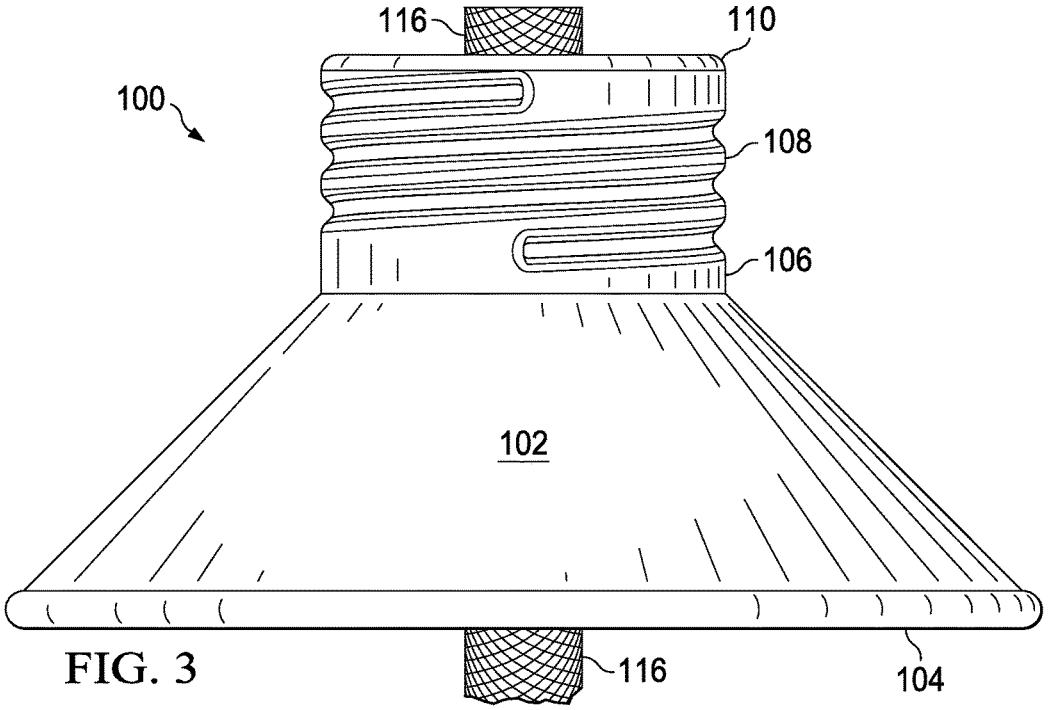
FIG. 3 is a side view of an opposite side of the burner of FIG. 2.
Figure 4:
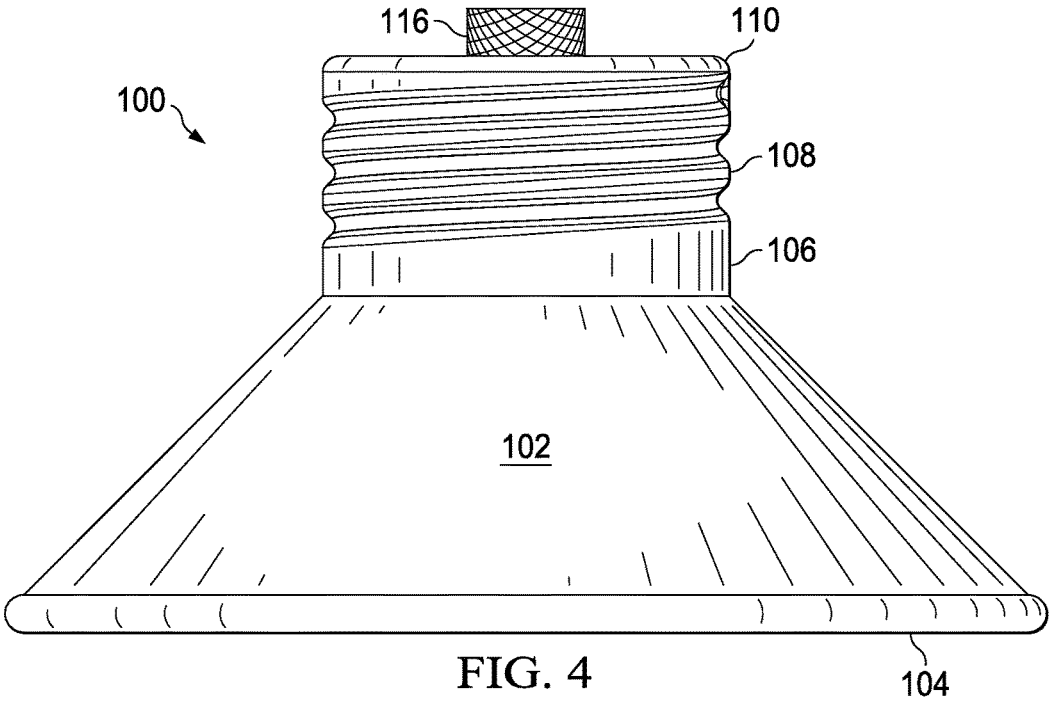
FIG. 4 is a side view of the burner of FIG. 2 rotated ninety degrees to the left.
Figure 5:
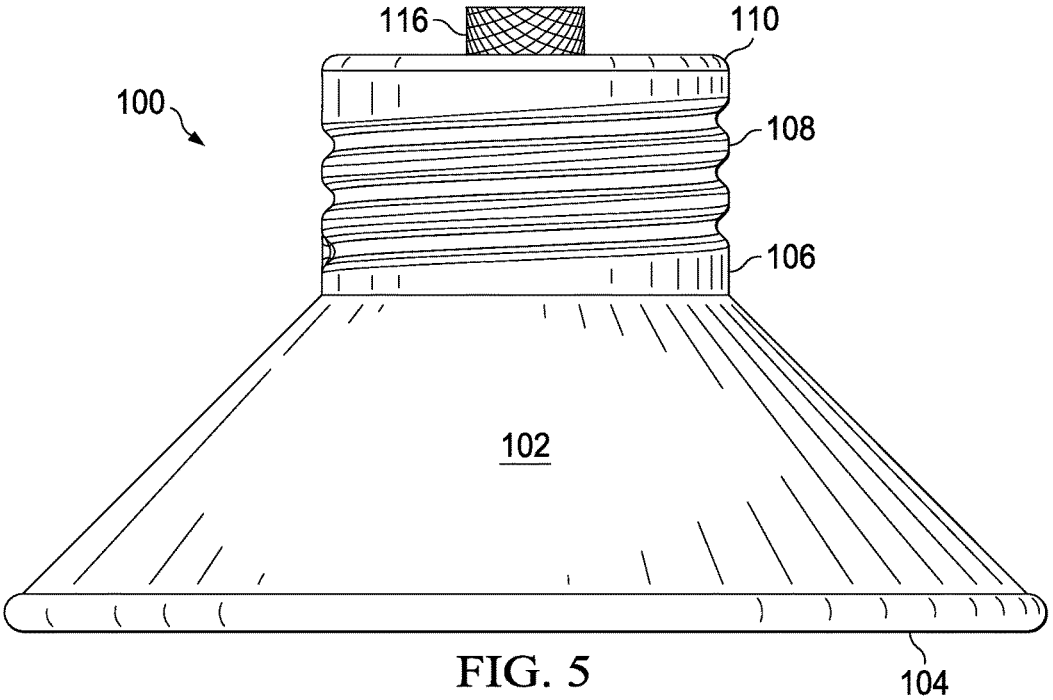
FIG. 5 is a side view of the burner of FIG. 2 opposite that shown in FIG. 4.

FIGS. 2 and 3 provide first and second side views of the cap 100. Here, once again, the skirt 102 with the lower rolled edge 104 can be seen affixed to the neck 106. The neck 106 provides threads or other attachment structures 108 and a somewhat rounded upper edge 110. The wick 116 can be seen extending partially above the rounded edge 110 and also extending below the rolled edge 104; and therefore being suitable for insertion into a fuel reservoir. For completeness of illustration, FIGS. 4 and 5 show a similar viewpoint to that of FIGS. 2 and 3 with a rotation of 90 degrees relative to FIGS. 2 and 3 respectively.

Figure 6:
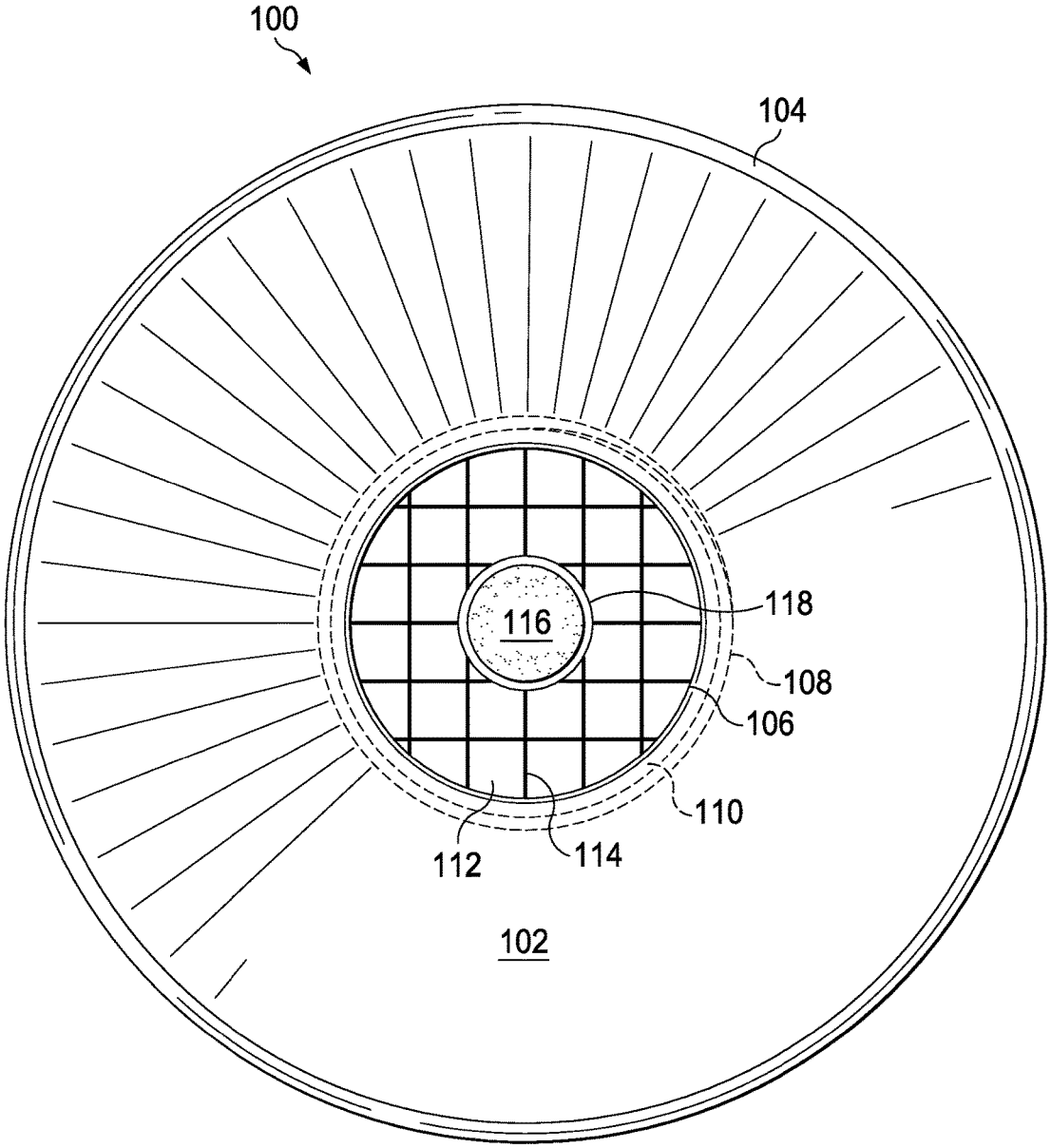
FIG. 6 is a superior view of the burner of FIG. 1A.

Referring now to FIG. 6, a superior view of the cap 100 is shown. In the present embodiment, the superior view of FIG. 6 corresponds to the perspective view of FIG. 1A. From the superior view, it can be seen that the rolled edge 104 of the skirt 102 circumscribes the skirt 102. The skirt 102 circumscribes the neck 106. A portion of the threads 108 can be seen affixed to the neck 106. The rounded edge 110 of the neck 106 flows into the indention 112 that contains the mesh insert 114. The wick holder 118 can be seen within the indention 112 retaining the wick 116 in a friction fit.

Figure 7:
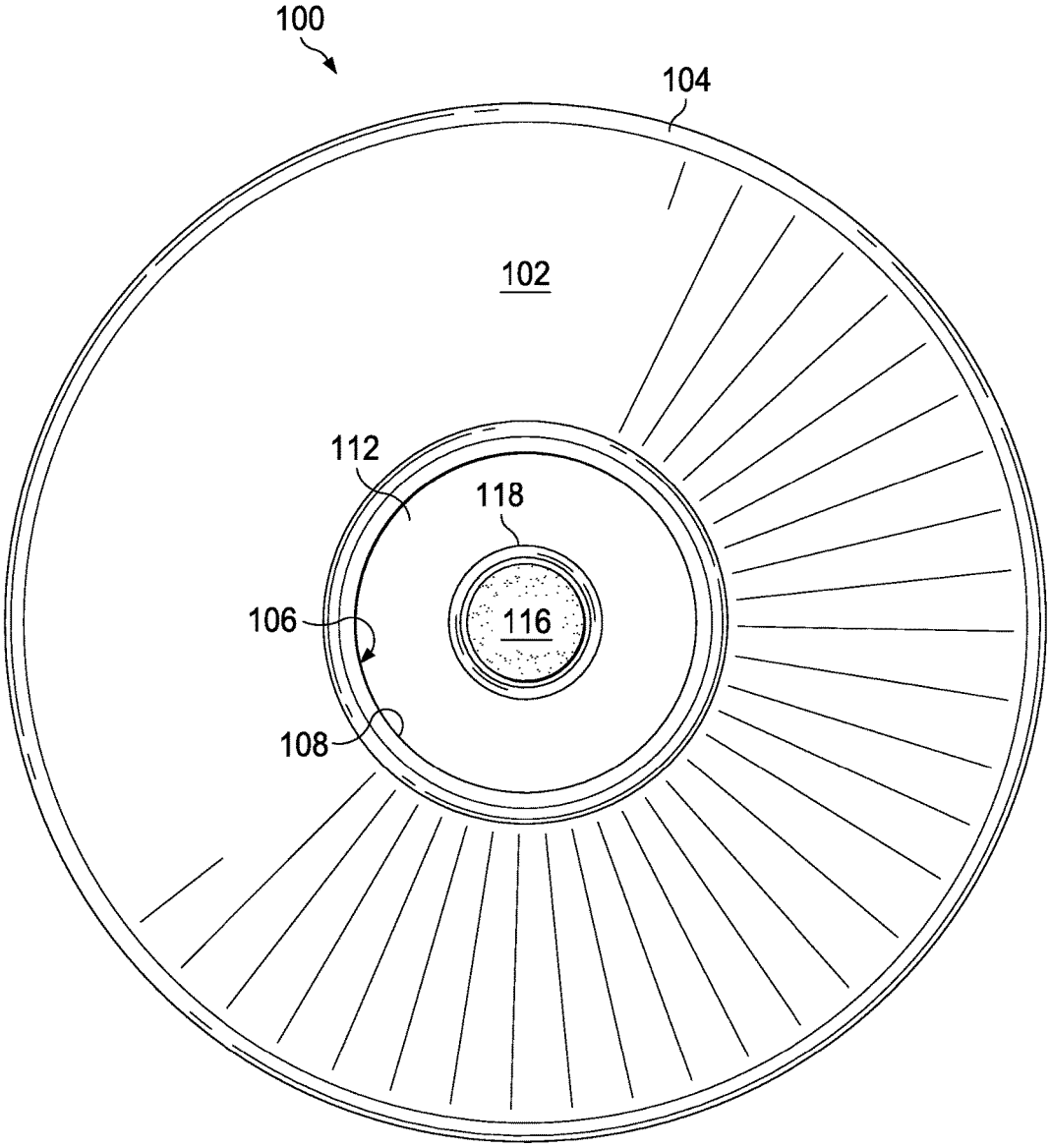
FIG. 7 is an inferior view of the burner of FIG. 1A.

Referring now to FIG. 7, an inferior view of the cap 100 is shown. The underside of the skirt 102 and rolled edge 104 can be seen circumscribing an inner portion of the neck 106. The threads 108 can be seen on the inner portion of the neck 106. The indention 112 can be seen circumscribing the wick holder 118, which retains the wick 116.

Figure 8:
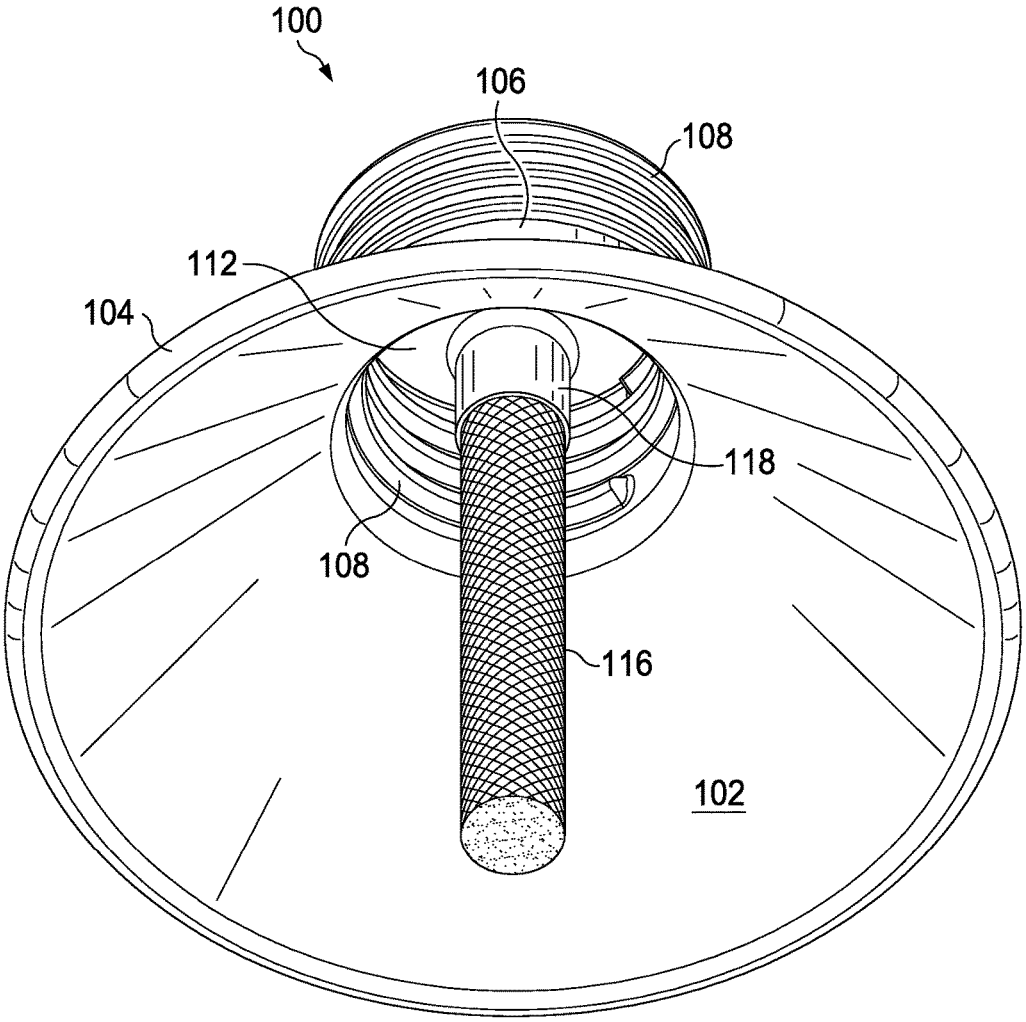
FIG. 8 is an inferior perspective view of a torch burner cap according to aspects of the present disclosure.

Referring now to FIG. 8, an inferior perspective view of the cap 100 is shown. From this viewpoint, it can be seen that, in the present embodiment, the wick holder 118 is defined as a hollow cylinder sized to accommodate the wick 116 but retain the same in a friction fit relationship. A portion of the indention 112 can also be seen inside the neck 106. It will be appreciated that the exact contour of the indention 112 may vary. In the present embodiment, the general shape of the indention 112 is that of a cup or semi-sphere.

Figure 9:
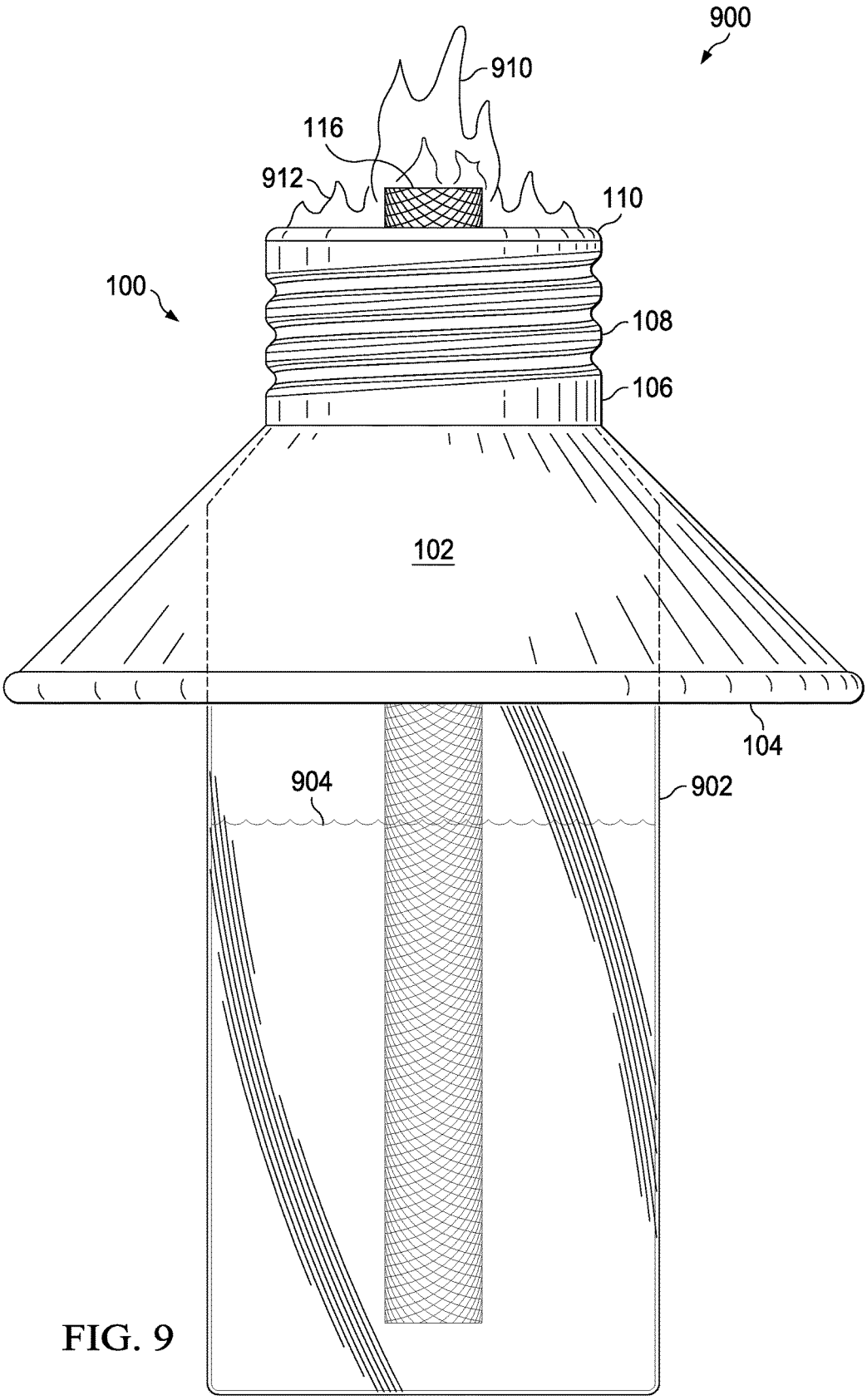
FIG. 9 is a side view of a liquid fueled torch according to aspects of the present disclosure.

Referring now to FIG. 9, a side view of a liquid fuel torch 900 is shown. FIG. 9 illustrates how the various embodiments of the cap 100 may affix to a fuel reservoir 902 that is shaped to contain a quantity of liquid torch fuel 904. The reservoir 902 affixes to the neck 106 of the cap 100 via the threads 108. It will be appreciated that the cap 100 and the reservoir may be secured together in other manners. For example, a friction fit or a snap lock relationship could also be provided between the reservoir 902 and the cap 100.

In some embodiments, the reservoir 902 may be clear or translucent to allow a user to easily determine the quantity of fuel 904 remaining in the reservoir 902. With the reservoir 902 securely affixed to the cap 100, the skirt 102 and/or the edge 104 also provide a support means for limiting how far into a housing or other device (not shown) the fuel reservoir 902 would be allowed to travel. For example, the entire structure 900 may be fitted into a lawn torch holder, a table torch holder, or some other device that enhances the utility of the torch 900.

As described previously, the cap 100 provides for an indention surrounding the wick 116. The indention contains an insert, which may be one of the many previously described. The insert promotes carbonization or sooting and fuel seepage from the wick 116 into the insert and the indention 112. This configuration promotes enhanced flame effects, such as a larger flame. A typical torch flame from a regular wick configuration is shown in the outline 910. An example of an enhanced flame that results from the configuration of the present disclosure is shown by the outline 912.

It will be appreciated that, as some of the components of the cap 100 may be subjected to heat emanating from the flames 910, 912, these may be formed from a heat resistant material such as a steel or other metal alloy. Various pressing, rolling, machining, and affixing methods may be employed as needed. Some of the components of the cap 100 may also be subject to continuous exposure to torch fuel and other chemicals. These may be made impervious, or at least resistant, to such chemicals through coatings or based on the properties of the underlying materials themselves. Weather resistance may also be considered in selecting materials and/or coatings—particularly where the cap 100 may remain outdoors for extended periods of time.

Figure 10:
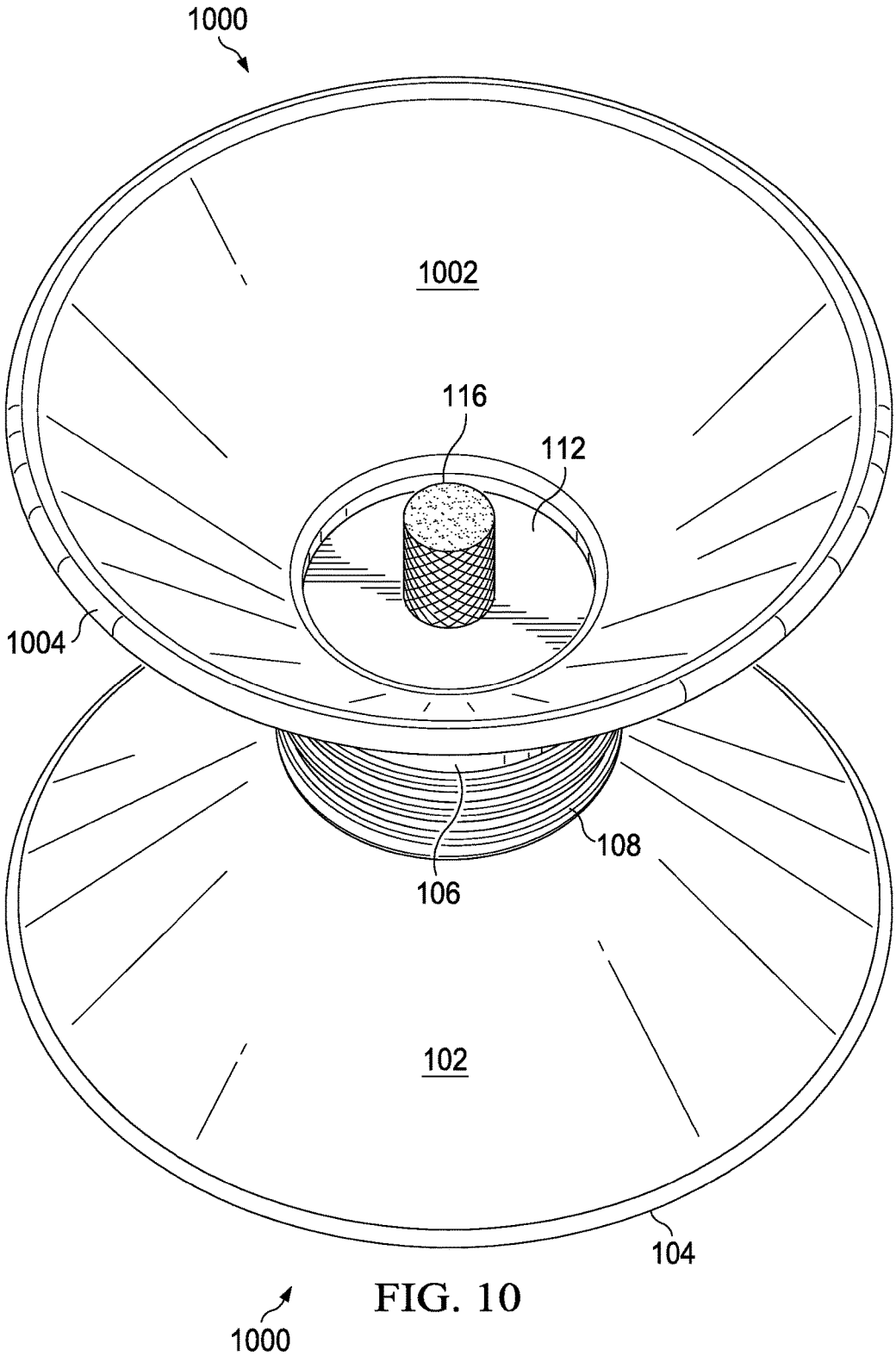
FIG. 10 is a perspective view of another torch burner cap according to aspects of the present disclosure.
Figure 11:
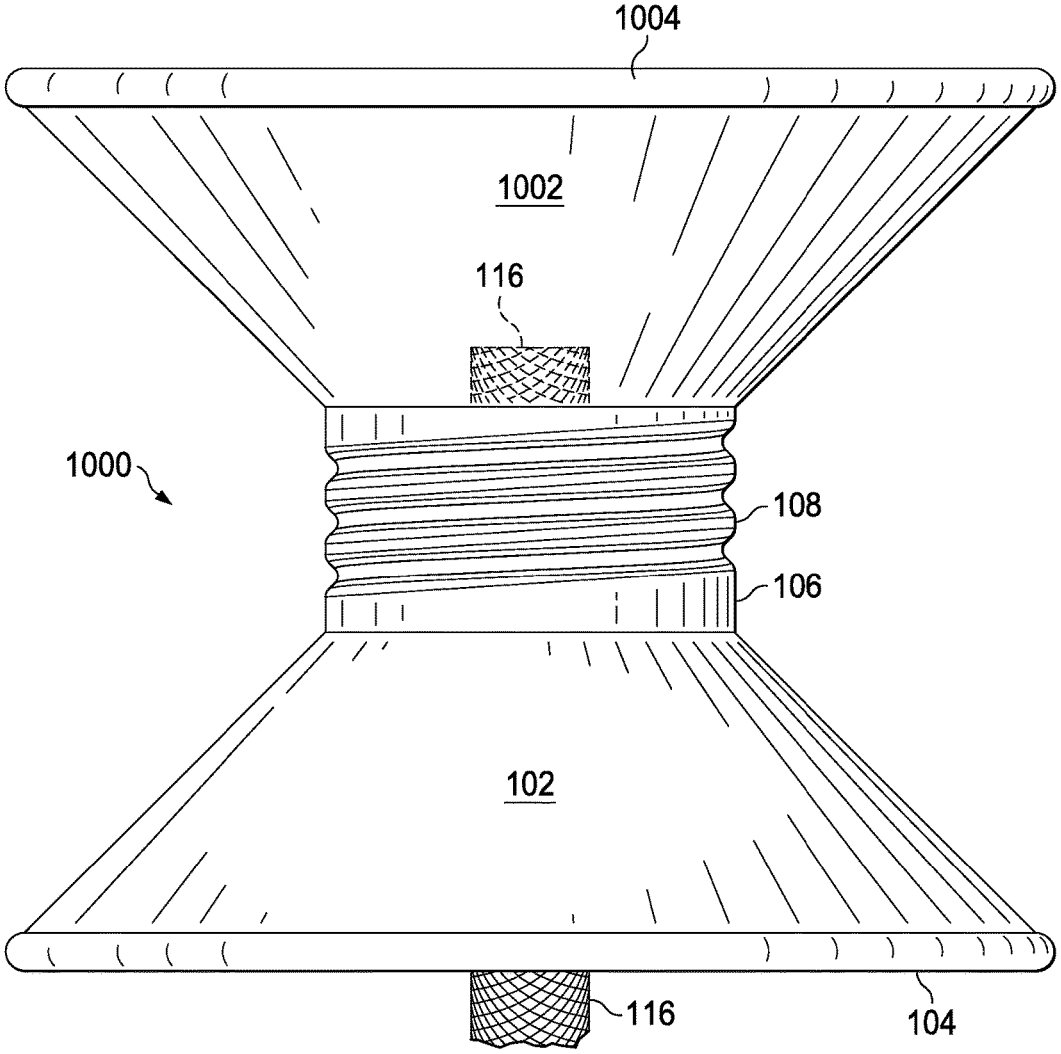
FIG. 11 is a side view of a first side of the torch burner cap of FIG. 10.
Figure 12:
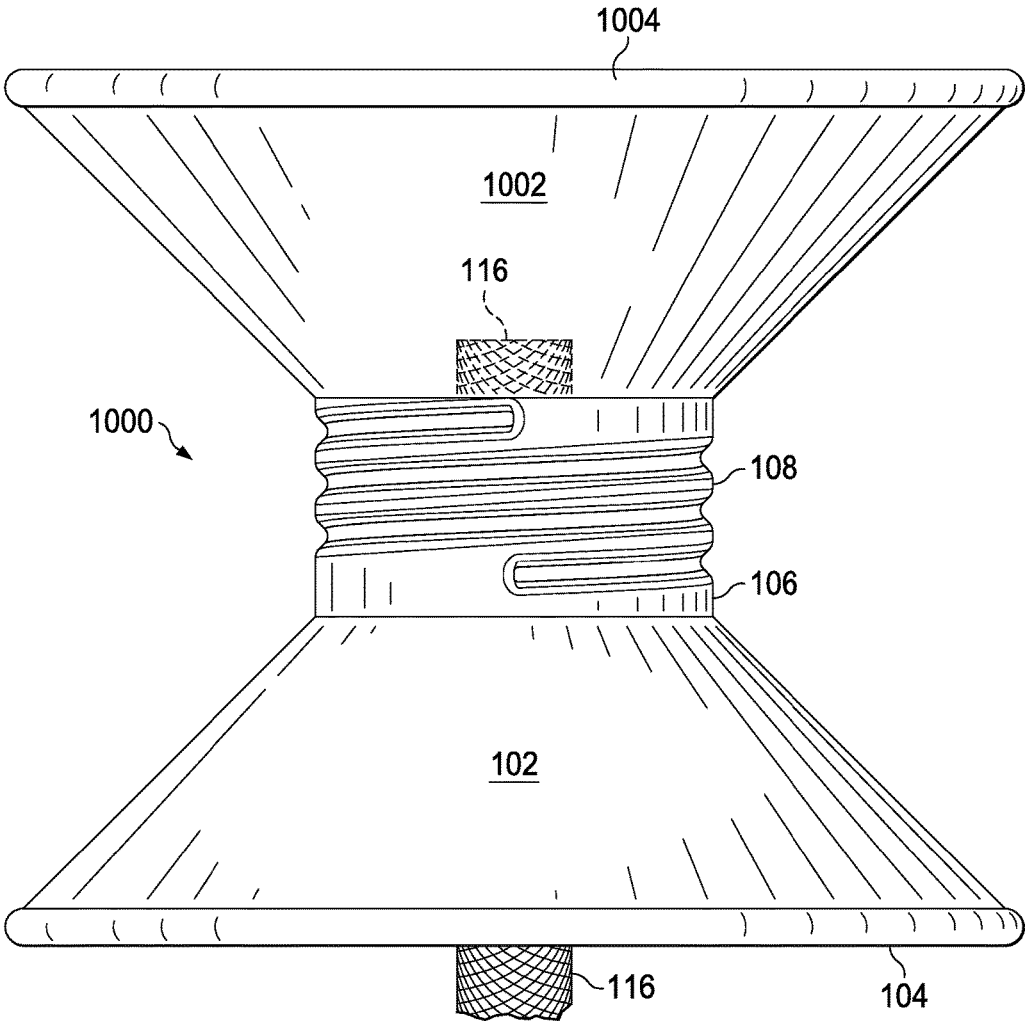
FIG. 12 is a side view of an opposite side of the burner of FIG. 10.
Figure 13:
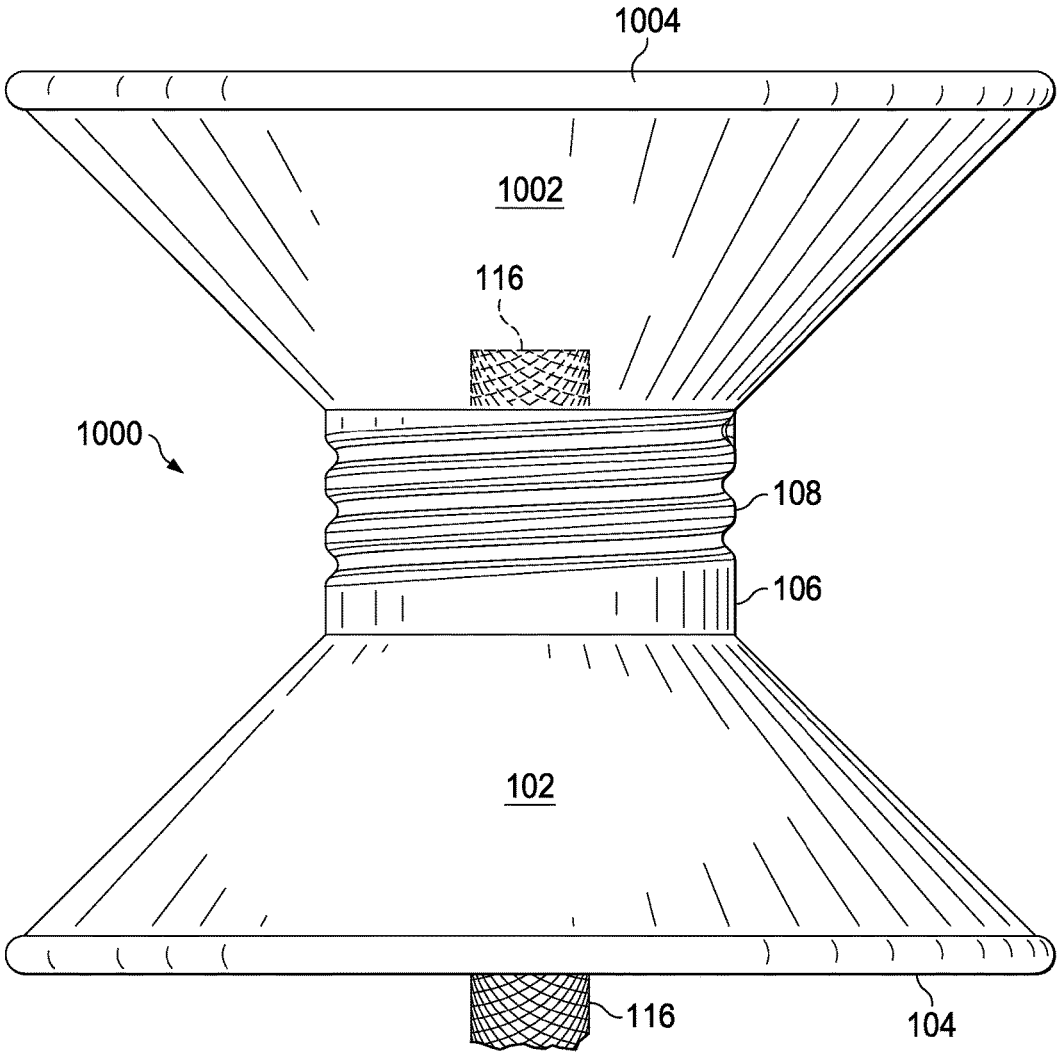
FIG. 13 is a side view of the burner of FIG. 10 rotated ninety degrees to the left.
Figure 14:
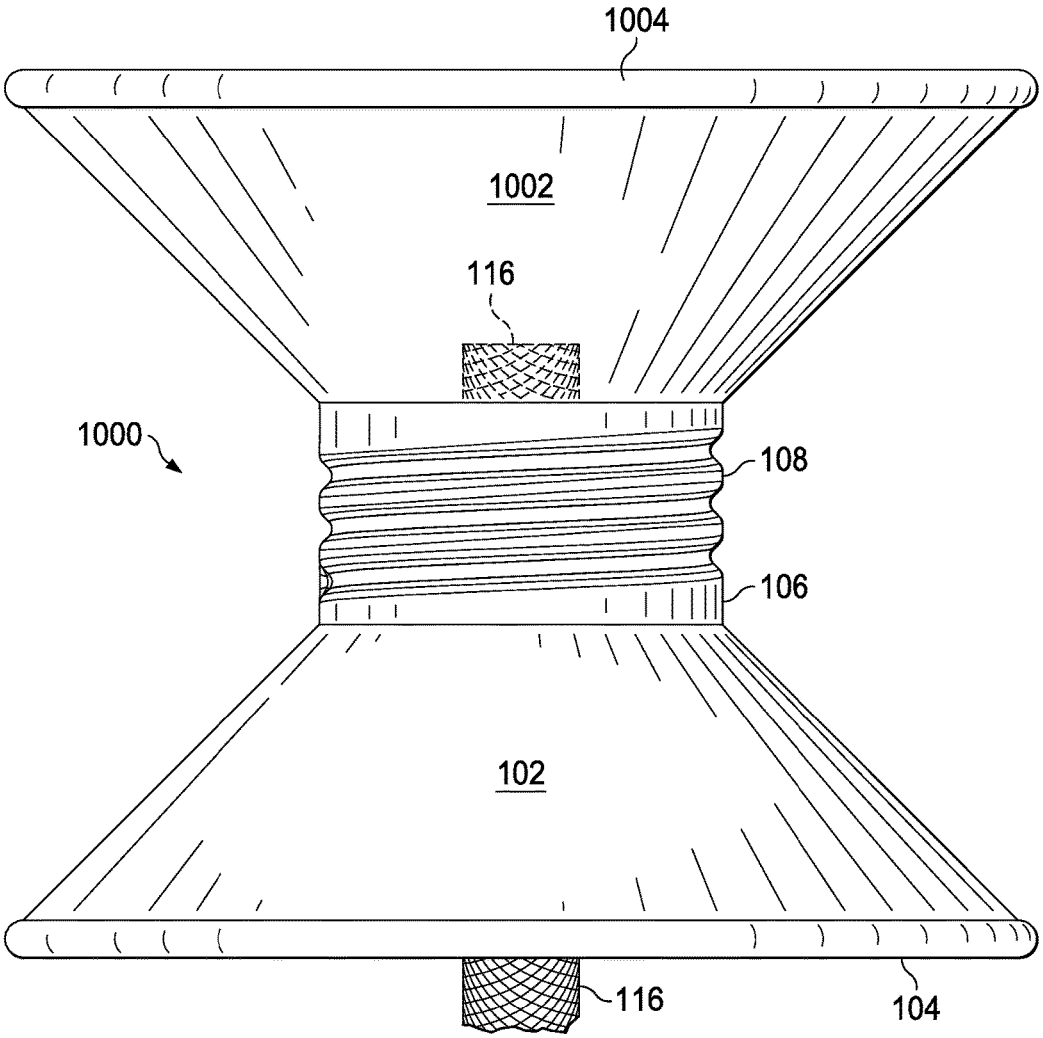
FIG. 14 is a side view of the burner of FIG. 10 opposite that shown in FIG. 13.
Figure 15:
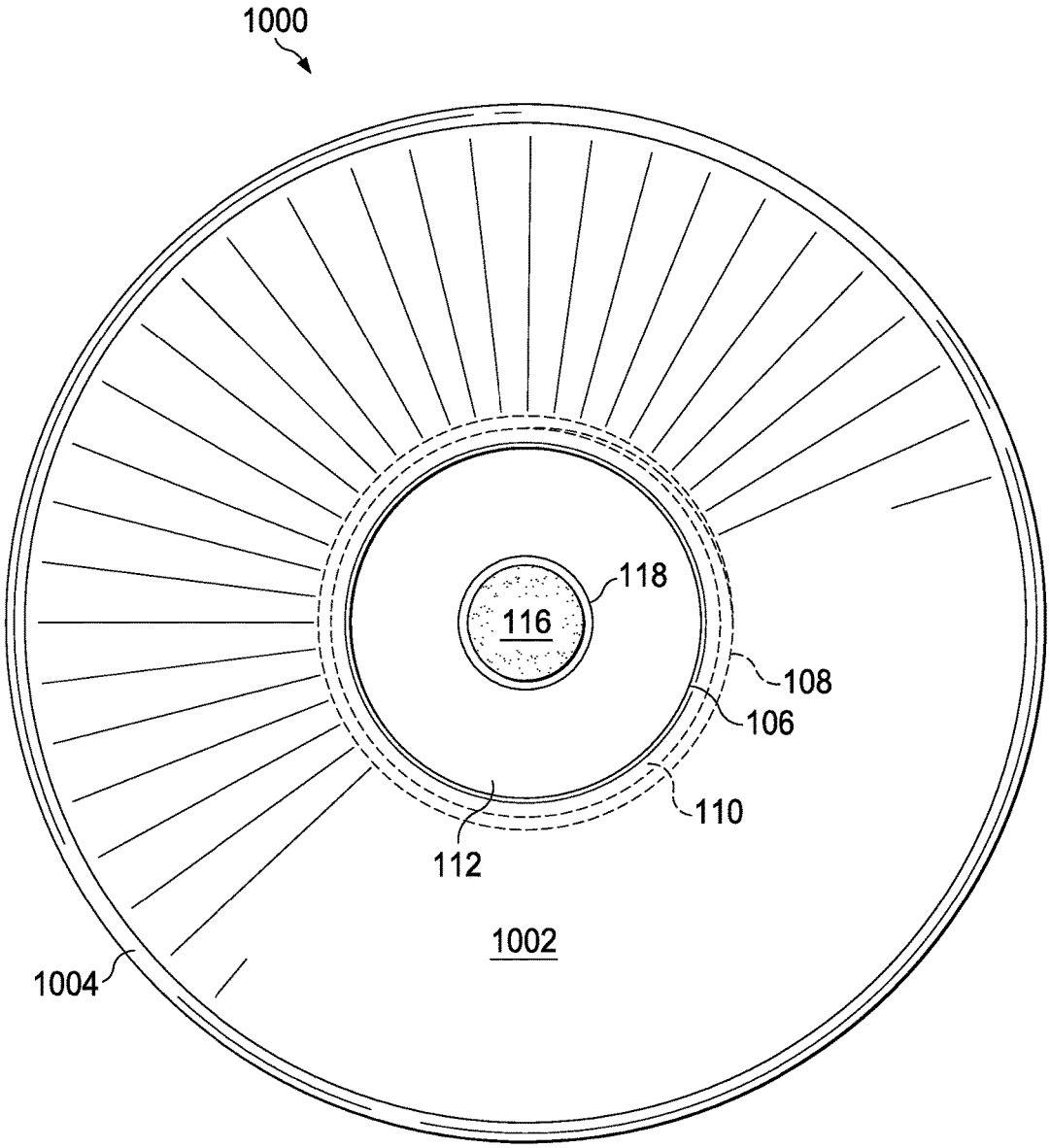
FIG. 15 is a superior view of the burner of FIG. 10.
Figure 16:
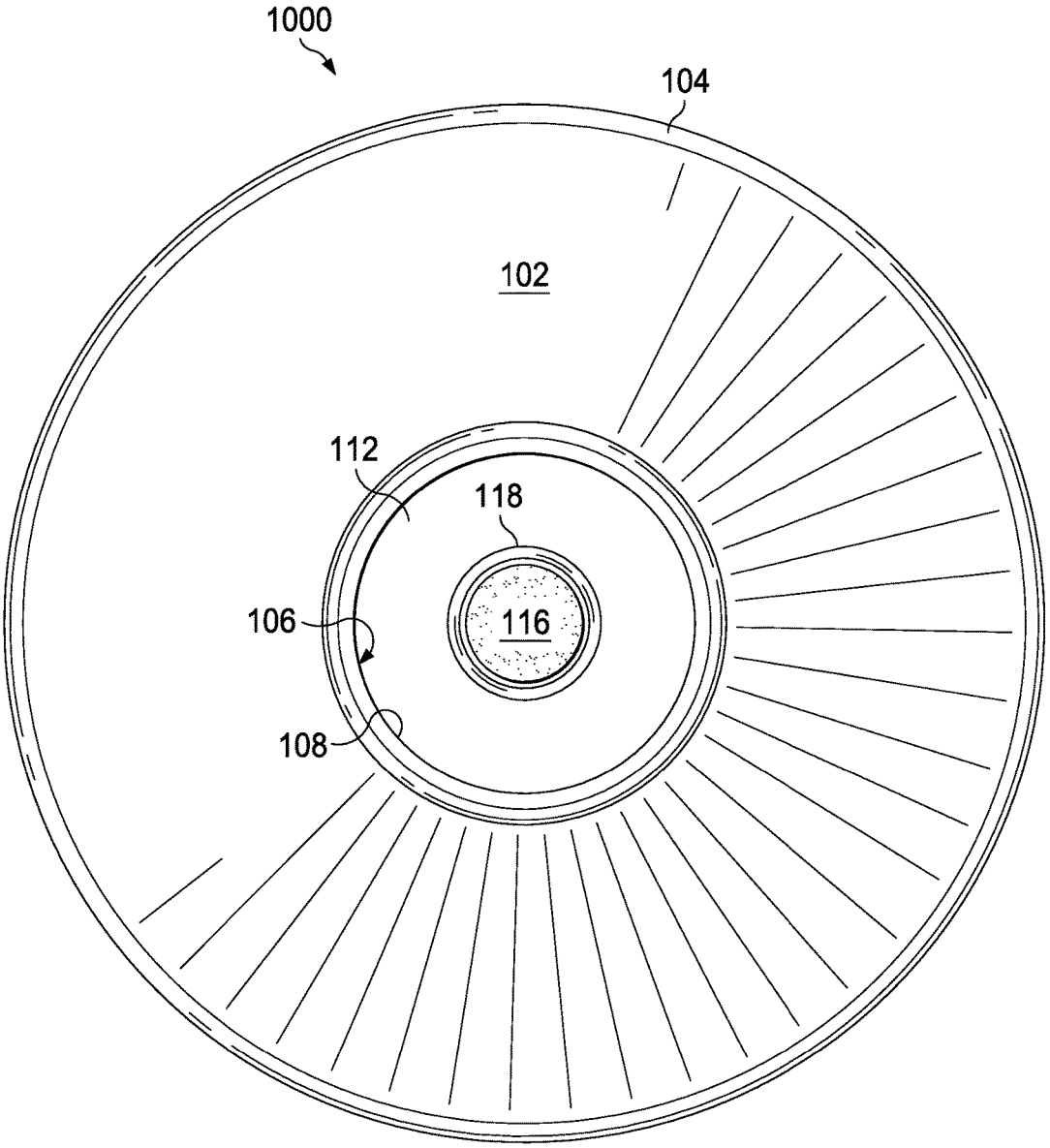
FIG. 16 is an inferior view of the burner of FIG. 10.
Figure 17:
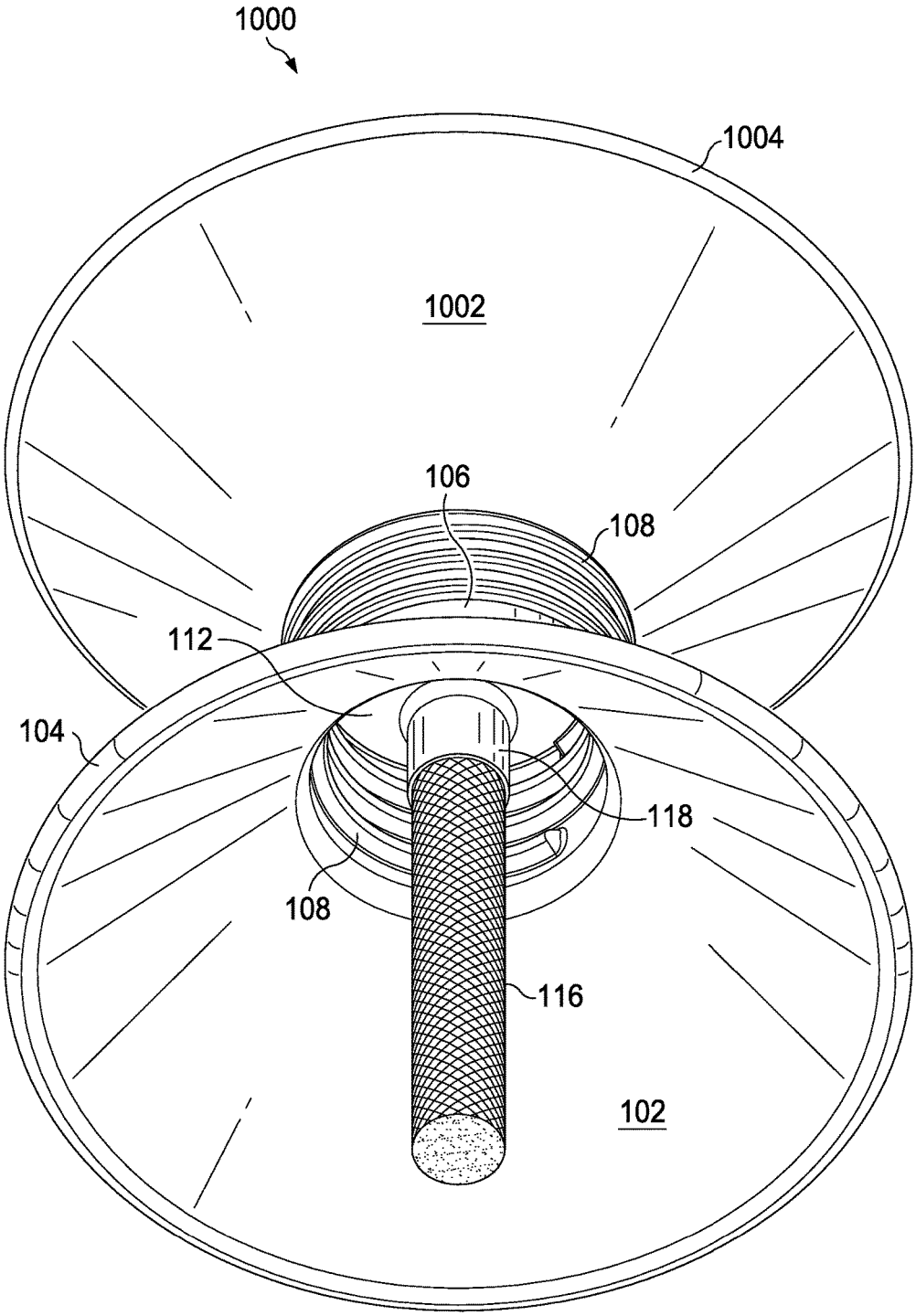
FIG. 17 is an inferior perspective view of the torch burner cap of FIG. 10.

Referring now to FIG. 10, a perspective view of another torch burner cap 1000 according to aspects of the present disclosure is shown. FIG. 11 is a side view of a first side of the torch burner cap of FIG. 10 and FIG. 12 is a side view of an opposite side of the burner of FIG. 10. FIG. 13 is a side view of the burner of FIG. 10 rotated ninety degrees to the left and FIG. 14 is a side view of the burner of FIG. 10 opposite that shown in FIG. 13. Superior and inferior views are shown in FIGS. 15 and 16, respectively. FIG. 17 is an inferior perspective view.

From the various drawings of the torch burner cap 1000, it can be seen that there are some similarities to the cap 100 of FIGS. 1-9. In the present embodiment, the cap 1000 has a skirt 102 with a lower rolled edge 104 that circumscribes a lower portion of a neck 106. In the present embodiment, a structure of a flame bowl 1002 with rolled edge 1004 substantially mirrors the arrangement of the skirt 102 and lower rolled edge 104. The diameter of the flame bowl 1002 (and skirt 102) will substantially match the diameter of the neck 106 at the point of attachment. The flame bowl 1002 will be larger in diameter that the neck further away, and may be up to 2.5 to 3 times as large in diameter at the rolled edge 1004 (the skirt 102 will have similar dimensions). Thus the flame bowl 1002 is considered a large flame bowl and is suitable for producing or containing a much larger flame 912 than would ordinarily be possible from the wick 116.

From FIGS. 10 and 15 is can be seen that the flame bowl 1002 may be empty but for the wick 116. However, in other embodiments, all or a portion of the flame bowl 1002 (aside from the wick) may be provided with a flame enhancing insert (not shown) for further enhancing flame effects. The insert may be similar to that of FIG. 1A, 1B, 1C, or 1D. It may comprise a wire or mesh insert of any porosity size. It may, instead, comprise pumice or other stone.

Figure 18:
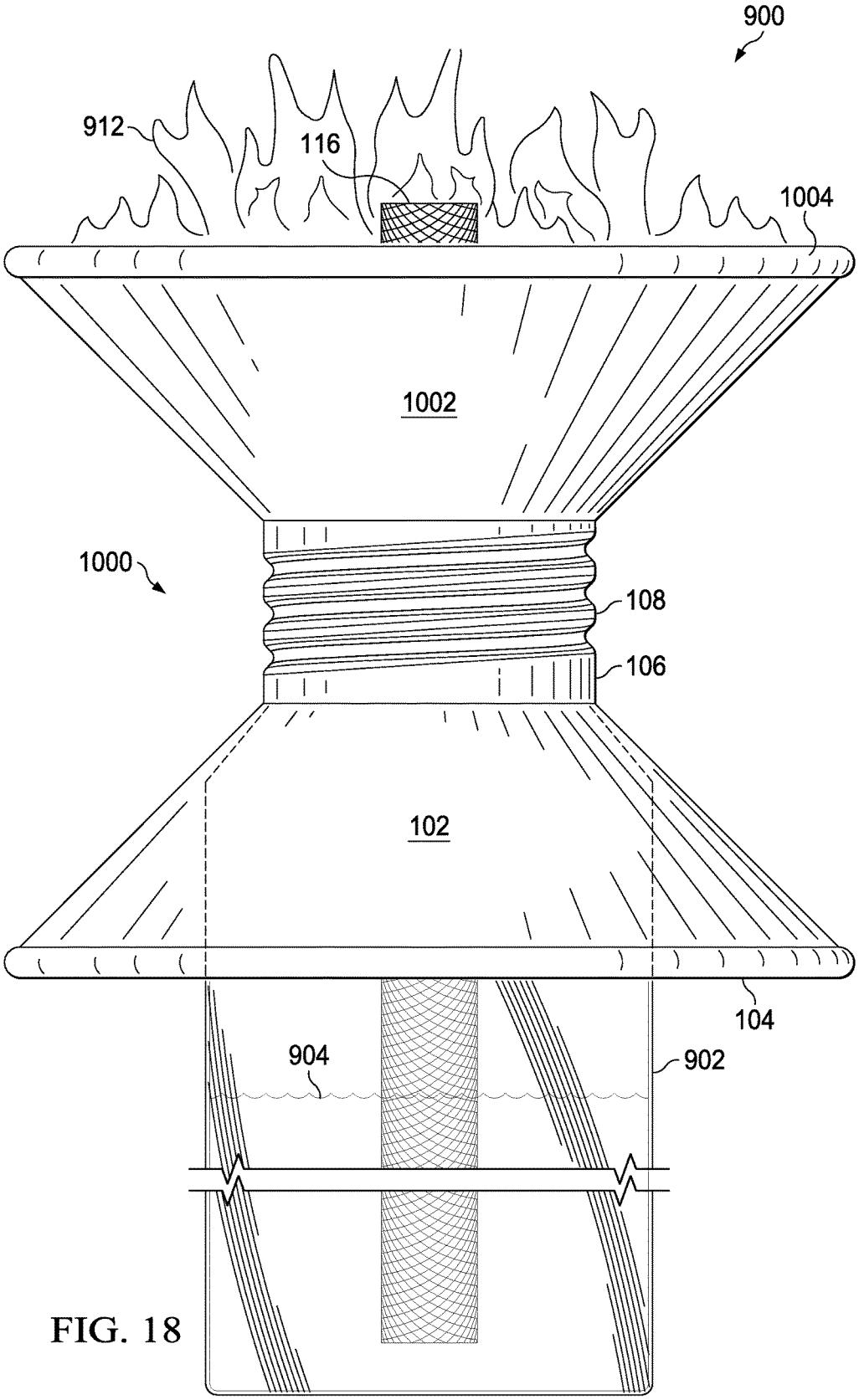
FIG. 18 is a side view of a liquid fueled torch utilizing the cap of FIG. 10 according to aspects of the present disclosure.

FIG. 18 is a side view of a liquid fueled torch utilizing the cap of FIG. 10 according to aspects of the present disclosure. FIG. 18 illustrates how the various embodiments of the cap 1000 may affix to the fuel reservoir 902 (as discussed above with respect to FIG. 9). Here again, the reservoir 902 affixes to the neck 106 of the cap 1000 via the threads 108. These may also attach by other means. For example, a friction fit or a snap lock relationship could also be provided between the reservoir 902 and the cap 1000.

As described previously, the cap 1000 may provide an insert for enhancing flame effects in the flame bowl 1002. As some of the components of the cap 1000 may be subjected to heat emanating from the flames 912, these may be formed from a heat resistant material such as a steel or other metal alloy. Various pressing, rolling, machining, and affixing methods may be employed as needed. Some of the components of the cap 1000 may also be subject to continuous exposure to torch fuel and other chemicals. These may be made impervious, or at least resistant, to such chemicals through coatings or based on the properties of the underlying materials themselves. Weather resistance may also be considered in selecting materials and/or coatings—particularly where the cap 1000 may remain outdoors for extended periods of time.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A torch burner cap comprising:

a fitting that is selectively attachable to and detachable from a fuel reservoir;

a cupped indention atop the fitting and defining a wick holder; and a mesh insert rising above the indention to a wick proceeding from the wick holder such that carbon and sooting of the mesh insert from the wick occurs during combustion of fuel from the wick.

2. The torch burner cap of claim 1, wherein the mesh insert comprises a wire screen.

3. The torch burner cap of claim 1, wherein the fitting is threaded for selective attachment and detachment with a fuel reservoir having a threaded neck.

4. The torch burner cap of claim 1, wherein the wick holder provides a friction fit for a fiberglass wick and suspends the wick in the fuel reservoir.

5. The torch burner cap of claim 1, further comprising a skirt surrounding the fitting and sized to cover the fuel reservoir.

* * * * *